US006368660B1

(12) United States Patent
Stoffers et al.

(10) Patent No.: US 6,368,660 B1
(45) Date of Patent: Apr. 9, 2002

(54) RETROREFLECTING ROAD MARKING SYSTEM

(75) Inventors: Hendrik Stoffers, Hattem; Klaas Nieuwenhuis, Heerde, both of (NL)

(73) Assignee: Akzo Nobel N.V. (NL)

( * ) Notice: Subject to any disclaimer, the term of this patent is extended or adjusted under 35 U.S.C. 154(b) by 0 days.

(21) Appl. No.: 09/443,405

(22) Filed: Nov. 19, 1999

Related U.S. Application Data

(63) Continuation of application No. PCT/EP98/03023, filed on May 19, 1998.

(30) Foreign Application Priority Data

May 20, 1997 (NL) ..... 1006086

(51) Int. Cl.[7] ..... B05D 5/06

(52) U.S. Cl. ..... 427/137; 427/163.4; 427/203; 427/204

(58) Field of Search ..... 427/136, 137, 427/203, 204, 163.4; 359/528, 540; 428/143

(56) References Cited

U.S. PATENT DOCUMENTS

| | | | | |
|---|---|---|---|---|
| 4,296,006 | A | * | 10/1981 | Bugdahl et al. |
| 4,609,587 | A | * | 9/1986 | Giordano et al. |
| 4,856,931 | A | * | 8/1989 | Bollag |
| 5,035,920 | A | * | 7/1991 | Smrt et al. |
| 5,380,549 | A | * | 1/1995 | Harvison |
| 5,437,907 | A | | 8/1995 | Peil et al. ..... 428/143 |
| 5,897,914 | A | * | 4/1999 | DePriest |

FOREIGN PATENT DOCUMENTS

| | | |
|---|---|---|
| DE | 42 44 665 | 11/1993 |
| EP | 0 237 315 | 9/1987 |
| EP | 0 385 746 | 9/1990 |
| GB | 2 255 099 | 10/1992 |
| JP | 1996-113920 | 5/1996 |
| WO | WO 93/11303 | 6/1993 |

OTHER PUBLICATIONS

*International Search Report—Oct. 1, 1998.*

* cited by examiner

*Primary Examiner*—Fred J. Parker
(74) *Attorney, Agent, or Firm*—Joan M. McGillycuddy

(57) ABSTRACT

Retroreflecting road marking system comprising applying a coating layer which is composed of a binder, glass beads, one or more pigments, and fillers, on which immediately after its application and prior to its complete cooling, drying and/or curing glass beads have been introduced, the coating layer comprising a composition composed of:

30–70 wt. % of glass beads having a particle size distribution in the range of 0.8 to 3.5 mm, 3–30 wt. % of $TiO_2$, 5–40 wt. % of fillers and/or aggregate, as well as 10–40 wt. % of binder, and the particle size distribution of the glass beads introduced immediately after application being in the range of 100 to 600 $\mu$m, preferably in the range of 100 to 300 $\mu$m. Through the effect of traffic the retroreflecting road marking system according to the invention attains good retroreflecting properties soon after application and also in the wet state and loses these properties far less quickly, even after busy traffic.

8 Claims, No Drawings

RETROREFLECTING ROAD MARKING SYSTEM

This is a continuation of International Application No. PCT/EP98103023, with an international filing date of May 19, 1998, designating the United States of America, presently pending, but expressly abandoned after the filing and acceptance of the present application. This application claims priority of Netherlands Patent Application No. 1006086 filed May 20, 1997.

BACKGROUND OF THE INVENTION

The invention pertains to a retroreflecting road marking system which comprises a coating layer composed of a binder, glass beads, one or more pigments, and fillers, on which immediately after its application and prior to its complete cooling, drying and/or curing glass beads have been introduced. Such a road marking system is known from JP-A-08113920.

The particle size of the glass beads in the known system is in the range of 2 to 5 mm, while that of the glass beads introduced immediately after application is in the range of 0.1 to 0.85 mm. The binder further incorporates a substance having a thixotropic effect, such as a synthetic wax, clay or particulate silica, while the selected ratio of glass bead to binder is such that the glass beads, although covered entirely by the binder, also provide a contoured surface. Onto this surface glass beads having dimensions in the range of 0.1 to 0.85 mm are then scattered.

Although the original reflecting properties of such a system are favorable under dry conditions, for a portion of the fine glass beads introduced after the application to be worn off by the abrasive effect of traffic, so that a portion of the larger beads is exposed and reflection is also obtained in the wet state, will take quite some time.

The examples included in this patent publication also show that just a few months after the fine glass beads have been worn off, the large beads with a particle size distribution in the range of 2 to 3.35 mm are likewise taken out by traffic. It is attempted to prevent the consequent marked deterioration in reflecting power by introducing a small percentage of medium-sized glass beads with a particle size distribution in the range of 1.18 to 2.36 mm into the coating layer along with the large beads. Because these medium-sized beads are exposed less quickly by traffic, the reflecting properties of the system, in the dry state only, are retained for quite some time. Due to the low percentage of these beads, however, the reflecting properties in the wet state will be substantially lower than they were immediately after the large glass beads were exposed by traffic several months after application.

SUMMARY OF THE INVENTION

The invention now provides a retroreflecting road marking system which, through the effect of traffic, attains good retroreflecting properties soon after application and also in the wet state and loses these properties far less quickly, even after busy traffic.

DETAILED DESCRIPTION OF THE INVENTION

The invention consists in that in a retroreflecting road marking system of the known type mentioned in the opening paragraph the coating layer comprises a composition composed of:

3014 70 wt. % of glass beads having a particle size distribution in the range of 0.8 to 3.5 mm, 3–30 wt. % of $TiO_2$, 5–40 wt. % of fillers and/or aggregate, as well as 10–40 wt. % binder, with the particle size distribution of the glass beads introduced immediately after application being in the range of 100 to 600 $\mu$m.

By introducing significantly more glass beads with a particle size distribution in the range of 0.8 to 3.5 mm into the coating layer than is the case in the aforesaid Japanese patent publication and, in addition, using much finer glass beads with a particle size distribution in the range of 100 to 600 $\mu$m after the application of the coating layer, a road marking system is obtained which after application attains reflecting properties much more rapidly also in the wet state, which reflecting properties not only are much higher than in the known systems, but which also are retained much longer in busy traffic.

It was found that significantly better results still can be obtained when the particle size distribution of the glass beads introduced immediately after application is in the range of 100 to 300 $\mu$m.

The use of large beads of the aforementioned sizes in a road marking system has also been proposed in GB-A-2 255 099.

However, the quantity introduced in said system is significantly smaller than in the compositions proposed here, while there is no question of small glass beads with a particle size in the range of 100 to 600 $\mu$m being introduced immediately after application. By contrast, in DE-A4244665 there is question of a high percentage of glass beads, but nothing is said as to the size of these beads. Again, there is no question of glass beads introduced after application, let alone of beads having a particle size in the range of 100 to 600 $\mu$m.

What is surprising in the use of these last glass beads is that there is a substantial increase in both retroreflecting power, as a result of an increase in the reflecting surface per $m^2$ of marking, and in abrasive action, due to the smaller dimensions (impairment of the top layer). Because of this, in traffic the large beads covered with binder and fine glass beads will wear off quickly at the top and start to protrude partially beyond the coating layer. Since this top will disappear less quickly underneath a film of water in wet conditions during rain, the retroreflecting power in the wet state consequently is retained. Using a significantly higher percentage of large glass beads than is disclosed in the Japanese patent publication makes for a reflection which is higher and will be removed far less quickly by the effect of traffic, so that the retroreflecting power is retained much longer.

According to the invention, generally very favorable results are obtained when the coating layer is composed of:

40–60 wt. % of glass beads having a particle size distribution in the range of 1.7 to 2.3 mm, 5–15 wt. % of $TiO_2$, 5–40 wt. % of fillers and/or aggregate having a particle size in the range of 50 to 2700 $\mu$m, and 10–20wt. % of binder.

A wide range of substances can be used as filler. Good results were achieved using $CaCO_3$, $MgCO_3$, $BaCO_3$, $BaSO_4$ or a water-insoluble silicate.

According to the invention, optimum results were obtained with glass beads having a particle size distribution in the range of 1.7 to 2.3 mm making up 45–55 wt. % of the coating layer composition. More particularly, optimum results were obtained employing a weight percentage of 48–52 wt. %.

Generally, favorable results are obtained when the quantity of glass beads introduced directly after application is 150–600 g/m$^2$.

According to the invention, a wide range of resins can be used as binder. As examples may be mentioned modified colophony, modified tall oil, acrylate resins, hydrocarbon resins or dispersion binders, optionally with a plasticiser incorporated. Examples of suitable plasticisers are mineral oils, vegetable oils, and paraffin wax. In order to keep the large glass beads from sagging when the liquid coating layer composition is applied, use may be made of thixotropic adjuvants. Examples of suitable thixotropic adjuvants are silica, clay, and fibrous materials.

In addition to the aforementioned constituents the road marking systems according to the invention can include the conventional raw materials for this type of coating, such as thickeners, fillers, pigments, plasticisers, and aggregates.

The key pigment, however, is $TiO_2$, of which 3 to 30 wt. % is included in the coating layer. For yellow markings use can be made of suitable yellow pigments.

The road marking systems according to the invention can be applied to a road surface in the conventional manner, e.g., with the aid of a guide strip (contour template), but extrusion can also be used. The system is used not only in conventional road markings but also as section marking. The invention will be further illustrated with reference to the following examples, which, of course, are not to be construed as being limiting in any manner whatsoever.

EXAMPLE 1

A coating layer composition was prepared by mixing the following constituents in the percentages by weight indicated:

| | Composition A (invention) | Composition B (prior art) |
|---|---|---|
| Hydrocarbon resin (Escorez 1102 ex Exxon) | 12 | 14 |
| Plasticisers (a.o. mineral oil Flexon 845 ex Exxon) | 3 | 3 |
| Pigment ($TiO_2$) | 10 | 8 |
| Calcium carbonate/silicon oxide 1 part Durcal 5 ex OMYA mixed with 4 parts of Grenette Minigrain ex Mosam | 5/20 | 30 |
| Limestone | | 20 |
| Glass beads (1.7–2.3 mm) | 50 | |
| glass beads <0.85 mm | | 25 |

After their application onto a road surface, a layer of fine glass beads was introduced on the two coating layers, with glass beads having a particle size distribution in the range of 100 to 300 $\mu$m being introduced on the coating layer of composition A and glass beads having a particle size distribution in the range of 100 to 850 $\mu$m being introduced on the coating layer of composition B. Next, a number of simulation experiments were carried out in which a particular traffic volume was simulated. After 3 weeks and subsequently after 6 months the reflection and the skid resistance of the coating layers were determined in the dry as well as the wet state. The reflection was determined with a reflectometer type Optronik DR023 in accordance with DIN 67520 at an angle of exposure of −86.5°, an angle of observation of 1.5° on a substrate with a measuring surface of 10×10 cm. The skid resistance was determined with a Skid Resistance (SRT) Tester.

The measuring data can be found in the Table I below.

TABLE I

| | | composition A (invention) | composition B (comparative) |
|---|---|---|---|
| reflection dry after | 3 weeks | 352 | 207 |
| | 6 months | 337 | 188 |
| reflection wet after | 3 weeks | 98 | 32 |
| | 6 months | 98 | 18 |
| skid resistance after | 3 weeks | 69 | 68 |
| | 6 months | 64 | 65 |

The measuring data listed in Table I clearly shows that, both in the wet and in the dry state and after 3 weeks as well as 6 months, the reflection of the coating layers according to the invention is substantially better than that of the known coating layers not including large glass beads. Nor does the use of a percentage of glass beads <30 wt. % always show the desired result, as was found in the examples of the Japanese patent publication described in the introduction.

EXAMPLE 2

Compositions A and B of Example I were applied with a layer thickness of 3 mm to the surface of a highway. After their application onto a road surface, a layer of fine glass beads was introduced on the two coating layers, with glass beads having a particle size distribution in the range of 100 to 300 $\mu$m being introduced on the coating layer of composition A and glass beads having a particle size distribution in the range of 100 to 850 $\mu$m being introduced on the coating layer of composition B.

Composition A was applied both to a part of the road surface with heavy traffic (HT) and a part with less heavy traffic (LHT). Composition B was applied to a part of the road surface with heavy traffic, only. After 3 weeks the reflection of the coating was determined in the dry state. After 6 months the reflection and the skid resistance of the coating layers were determined in the wet state. The reflection was determined with a reflectometer type ZRM 1012 (Zehntner) in accordance with DIN 67520 at an angle of exposure of −86.50, an angle of observation of 1.5° on a substrate with a measuring surface of 10×10 cm. The skid resistance was determined with a Skid Resistance (SRT) Tester.

The measuring data can be found in the Table II below.

TABLE II

| | composition A (invention) | | composition B (comparative) |
|---|---|---|---|
| Type of traffic | HT | LHT | HT |
| Reflection dry after application | 354 | | — |
| Reflection dry after 6 months | 280 | 214* | — |
| Reflection wet after 6 months | 100 | 81 | 15 |
| Skid resistance after application | 74 | — | — |
| Skid resistance after 6 months | 54 | 50 | — |

*during the measurement it started to rain

The measuring data listed in Table II clearly shows that, especially in the wet state, the reflection of the coating layers according to the invention is substantially better than that of the known coating layers not including large glass beads.

We claim:

1. A process for coating a substrate comprising:

applying to the substrate a coating layer having 30–70 wt. % of a first set of glass beads having a particle size distribution of about 0.8 to 3.5 mm, 3–30 wt. % of $TiO_2$, 5–40 wt. % of filler and/or aggregate, and 10–40 wt. % of binder;

adding a second set of glass beads having a particle size distribution of about 100 to 600 $\mu$m to the coating layer immediately after the coating layer is applied to the substrate and prior to its complete curing; and curing the coating layer.

2. A process for coating a substrate according to claim 1, wherein the particle size distribution of the second set of glass beads is about 100 to 300 $\mu$m.

3. A process for coating a substrate according to claim 1, wherein the first set of glass beads is present in 40–60 wt. % and have a particle size distribution of about 1.7 to 2.3 mm, the $TiO_2$ is 5–15 wt. %, the filler and/or aggregate is 5–40 wt. % and the binder is 10–20 wt. %.

4. A process for coating a substrate according to claim 1, wherein the filler is made of $CaCO_3$, $MgCO_3$, $BaCO_3$, $BaSO_4$ or a water-insoluble silicate.

5. A process for coating a substrate according to claim 1, where n the first set of glass beads have a particle size of about 1.7 to 2.3 mm and make up 45–55 wt. % of the coating layer.

6. A process for coating a substrate according to claim 1, wherein the first set of glass beads have a particle size distribution of about 1.7 to 2.3 mm and make up 48–52 wt. % of the coating layer.

7. A process for coating a substrate according to claim 1, wherein the second set of glass beads is present in an amount of 150–600 $g/m^2$.

8. A process for coating a substrate according to claim 1, wherein the binder is made of modified colophony, a modified tall oil, an acrylate resin, a hydrocarbon resin or a dispersion binder.

* * * * *